US010619506B2

(12) United States Patent
Toni et al.

(10) Patent No.: US 10,619,506 B2
(45) Date of Patent: Apr. 14, 2020

(54) MEASURING TOTAL PRESSURE OF A FLUID IN A TURBO MACHINE

(71) Applicant: Nuovo Pignone Tecnologie Srl, Florence (IT)

(72) Inventors: Lorenzo Toni, Florence (IT); Roberto Magni, Florence (IT); Federico Crugnola, Florence (IT)

(73) Assignee: Nuovo Pignone S.r.l., Florence (IT)

( * ) Notice: Subject to any disclaimer, the term of this patent is extended or adjusted under 35 U.S.C. 154(b) by 111 days.

(21) Appl. No.: 15/568,651

(22) PCT Filed: Apr. 22, 2016

(86) PCT No.: PCT/EP2016/059007
§ 371 (c)(1),
(2) Date: Oct. 23, 2017

(87) PCT Pub. No.: WO2016/170114
PCT Pub. Date: Oct. 27, 2016

(65) Prior Publication Data

US 2018/0156059 A1 Jun. 7, 2018

(30) Foreign Application Priority Data

Apr. 23, 2015 (IT) ..... FI2015A0118

(51) Int. Cl.
*F01D 17/08* (2006.01)
*F01D 5/14* (2006.01)
(Continued)

(52) U.S. Cl.
CPC ..... *F01D 17/08* (2013.01); *F01D 5/043* (2013.01); *F01D 5/048* (2013.01); *F01D 5/14* (2013.01);
(Continued)

(58) Field of Classification Search
CPC ... F01D 5/043; F01D 5/14; F01D 9/02; F01D 17/02; F01D 17/08; F01D 5/048; F05D 2260/80
See application file for complete search history.

(56) References Cited

U.S. PATENT DOCUMENTS 2,946,221 A 7/1960 Annear et al.
4,433,584 A * 2/1984 Kokoszka ..... G01P 5/175 73/861.66
(Continued)

FOREIGN PATENT DOCUMENTS

EP 2 224 379 A1 9/2010
WO 2013/169508 A1 11/2013

OTHER PUBLICATIONS

Search Report and Written Opinion issued in connection with corresponding IT Application No. FI2015A000118 dated Jan. 14, 2016.
(Continued)

*Primary Examiner* — Sizo B Vilakazi
(74) *Attorney, Agent, or Firm* — Baker Hughes Patent Organization

(57) ABSTRACT

A turbomachine airfoil component is disclosed, having a leading edge and a trailing edge. The airfoil component comprises a hole extending from an inlet positioned at the leading edge towards the interior of the airfoil component and forming a total pressure probe. The hole is fluidly connected to a pressure measuring device.

19 Claims, 3 Drawing Sheets

(51) Int. Cl.
*F01D 9/02* (2006.01)
*F01D 17/02* (2006.01)
*F01D 5/04* (2006.01)

(52) U.S. Cl.
CPC ..... *F01D 9/02* (2013.01); *F01D 17/02* (2013.01); *F05D 2260/80* (2013.01)

(56) References Cited

U.S. PATENT DOCUMENTS 4,733,975 A * 3/1988 Komanetsky ..... G01K 13/02 244/53 R
5,731,507 A 3/1998 Hagen et al.
6,036,432 A * 3/2000 Sishtla ..... F04D 27/0284 415/119
6,430,996 B1 8/2002 Anderson et al.
2005/0287386 A1 12/2005 Sabol et al.
2009/0297334 A1* 12/2009 Norris ..... F01D 17/08 415/49
2011/0262273 A1 10/2011 Behnisch et al.
2014/0182292 A1* 7/2014 Hudon ..... F01D 21/003 60/722
2016/0032757 A1* 2/2016 Liu ..... G01K 13/02 416/1
2016/0348531 A1* 12/2016 Rice ..... F01D 17/08
2017/0254723 A1* 9/2017 Prince ..... G01M 9/06

OTHER PUBLICATIONS

International Search Report and Written Opinion issued in connection with corresponding PCT Application No. PCT/EP2016/059007 dated Sep. 9, 2016.
International Preliminary Report on Patentability issued in connection with corresponding PCT Application No. PCT/EP2016/059007 dated Oct. 24, 2017.

* cited by examiner

MEASURING TOTAL PRESSURE OF A FLUID IN A TURBO MACHINE

FIELD OF INVENTION

The present application and the resultant patent relate generally to pressure measurement arrangements for turbomachines. In particular, the present disclosure specifically refers to devices and methods for measuring total pressure of working fluids in turbomachines, such as turbines and compressors.

BACKGROUND OF THE INVENTION

Turbomachines, such as turbines and compressors, are often provided with measurement arrangements for measuring several operating parameters. One such operating parameter is the total pressure of the working fluid, i.e. the fluid which flows through the turbomachine. In general terms, according to Bernoulli's principle, the total pressure is the sum of static pressure, dynamic pressure and gravitational head. In most applications, gravitational head can be ignored and the total pressure becomes the sum of dynamic pressure and static pressure.

The total pressure is often a useful parameter for testing purposes on prototype turbomachines. Total pressure can also be a useful control parameter during normal operation of an industrial turbomachine, which can be utilized e.g. for diagnostic purposes or for controlling the turbomachine functionality.

In some applications, the total pressure at the leading edge region of a stationary blade, an inlet guide nozzle, a nozzle guide vane, a return channel blade, a vaned diffuser blade, or other aerodynamic component can be required for control or testing purposes. Total pressure probes must be capable of providing reliable measurements also in case the angle of incidence of the fluid flow deviates with respect to the design angle of incidence. Known means of total pressure measurement at the leading edge of airfoil component include Pitot or Kiel-type probes installed in the desired measurement location, or shielded probes brazed or welded to the outer surface of the airfoil component. These probes are prone to malfunctioning and can accidentally separate from the airfoil component, such that the measurement data are lost.

A need therefore exists for a more efficient and reliable way of measuring total pressure of working fluid at the leading edge of airfoil components in turbomachines.

BRIEF DESCRIPTION OF THE INVENTION

According to one aspect, a turbomachine airfoil component is disclosed, having a leading edge and a trailing edge and comprising a hole extending from a hole inlet at the leading edge towards the interior of the airfoil component and forming a total pressure probe, and a passage in the airfoil component, for connecting the hole to a total pressure measuring device. The total pressure measuring device can be comprised of a sensor or transducer arranged in the passage. In other embodiments, the total pressure measuring device can be arranged at a distance from the airfoil component, e.g. outside the turbomachine where the airfoil component is located. A fluid connection can be provided between the total pressure probe formed by the hole in the airfoil component and the distant total pressure measuring device. The same static pressure will be present in the hole and in the whole fluid connection towards the total pressure measuring device.

For an improved accuracy, according to some embodiments the leading edge comprises a flattened surface, where the hole inlet is located. I.e. the leading edge can be partly planar, around the hole inlet. This renders the total pressure measurement less sensitive to variations of the fluid flow direction of incidence, making the measurement reliable also within a relatively broad range of variations of the angle of incidence.

The hole can be a countersunk hole, i.e. the hole inlet can be flared with a an embodiment conical inlet surface.

The airfoil component can be a stationary blade or bucket of a turbomachine. In some embodiments, the airfoil component is a return channel blade or a diffuser blade of a centrifugal compressor.

According to a further aspect, the present disclosure relates to a turbomachine comprising at least one stationary airfoil component as above described.

According to some embodiments, the turbomachine is a centrifugal compressor comprising: a casing; at least a first impeller, mounted for rotation in the casing; a diffuser stationarily arranged in the casing and along a flow path of the working fluid, i.e. the fluid processed by the compressor. The diffuser is provided with stationary blades therein and at least one of said stationary blades is an airfoil component as above described.

In other embodiments, the turbomachine is a centrifugal compressor comprising: a casing; at least a first impeller, mounted for rotation in the casing; a diffuser and a return channel stationarily arranged in the casing and along a flow path of the working fluid. At least one of the diffuser and the return channel is provided with stationary blades therein and at least one of said stationary blades is an airfoil component as above described. The return channel can usually be arranged between the first impeller and a downstream second impeller.

According to yet a further aspect, disclosed herein is a method of measuring a total pressure of a working fluid in a flow path inside a turbomachine, comprising the following steps: providing at least an airfoil component in the flow path, said airfoil component having a leading edge and a trailing edge; providing a hole extending from a hole inlet located at the leading edge of the airfoil component towards the interior of the airfoil component; causing the working fluid to flow in the hole transforming kinetic energy thereof into pressure energy in the hole; measuring the pressure in the hole.

The method can further comprise the step of providing a flattened surface portion on the leading edge and arranging the hole inlet at said flattened surface portion.

According to some embodiments, the method can further comprise the step of arranging said flattened surface portion at approximately 90° to a design direction of incidence of the working fluid with respect to the leading edge of the airfoil component.

According to further embodiments, the method can further comprise the step of providing a flared inner surface at the hole inlet.

The method can also further comprise the step of fluidly connecting the hole with a pressure measuring device arranged outside a casing of the turbomachine. In other embodiments, the method comprises the steps of: arranging a pressure measuring device inside the airfoil component, configured and arranged for measuring the pressure in the hole; and transmitting pressure measurement data from the pressure measuring device to the exterior of the turbomachine.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

The following description and attached drawings refer to a particularly useful application of the total pressure measurement arrangement disclosed herein to a return channel blade in a centrifugal compressor, for measuring the total pressure of the gas processed by the compressor at the leading edge of the return channel blades. The measurement arrangement can however be embodied also in other airfoil components for turbomachines, in particular stationary airfoil components for turbomachines, such as inlet guide vanes, diffuser blades, inlet guide nozzles, struts, among others.

Figure 1:
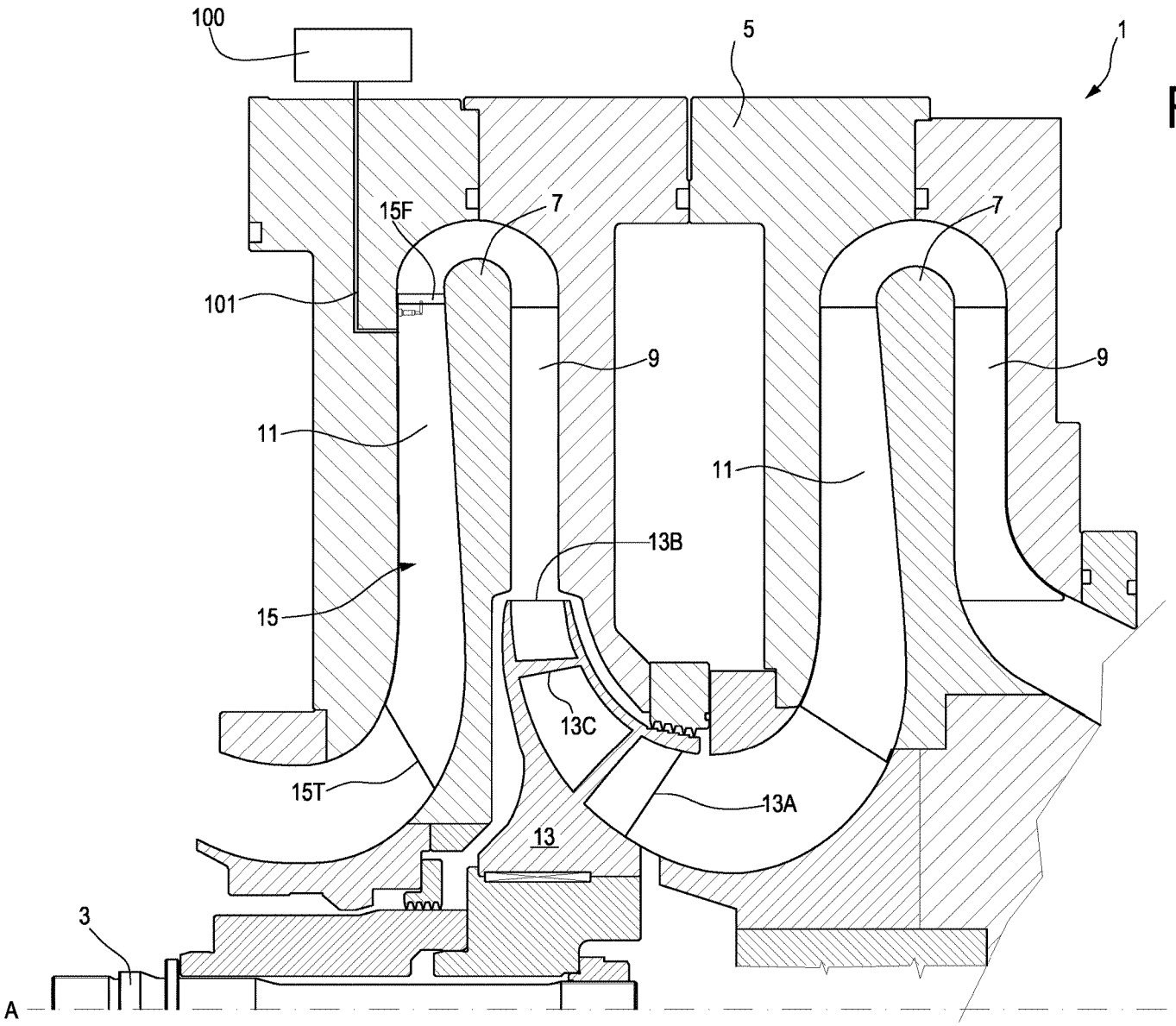
FIG. 1 illustrates a schematic partial sectional view of a multistage centrifugal compressor including a bladed return channel.

Referring to FIG. 1, a centrifugal compressor 1 is partially shown in a section according to a plane containing the rotation axis A-A of the compressor. Only a portion of the centrifugal compressor 1 is shown in FIG. 1. The centrifugal compressor 1 can be comprised of a shaft 3 rotatingly housed in a compressor casing 5. Diaphragms 7 are stationarily mounted in casing 5 and define diffusers 9 and return channels 11, which fluidly connect sequentially arranged impellers 13, whereof only one is shown in FIG. 1. At least one of the return channels 11 of the centrifugal compressor 1 can be provided with stationary return channel blades 15. Each return channel blade 15 is comprised of a leading edge 15L and a trailing edge 15T.

In FIG. 1 only one impeller 13 is shown, which can be provided with a substantially axially-oriented inlet 13A and a substantially radially-oriented outlet 13B, the axial and radial orientation being referred to the rotation axis A-A of compressor 1. Blades 13C of impeller 13 accelerate the gas entering the impeller at 13A. The accelerated gas exits the impeller 13 at 13B and is slowed down along the diffuser 9 arranged around the impeller outlet 13B, such that kinetic energy of the accelerated gas is converted into pressure along the diffuser 9. The gas is then returned from the radial outermost end of the diffuser 9 along the return channel 11 towards the inlet of a second, downstream impeller (not shown).

For the purpose of measuring the total gas pressure at the inlet of the return channel 11, at least one of the return channel blades 15 can be provided with a total pressure measurement arrangement as described herein after and shown in FIGS. 2 to 6. Even though reference will be made herein to a single return channel blade 15, it shall be understood that several or all return channel blades 15 in the same return channel 11 can be provided with a total pressure measurement arrangement, if desired. This may be the case e.g. if fluctuations or distortions of the total pressure in the tangential direction shall be detected and measured.

Figure 2:
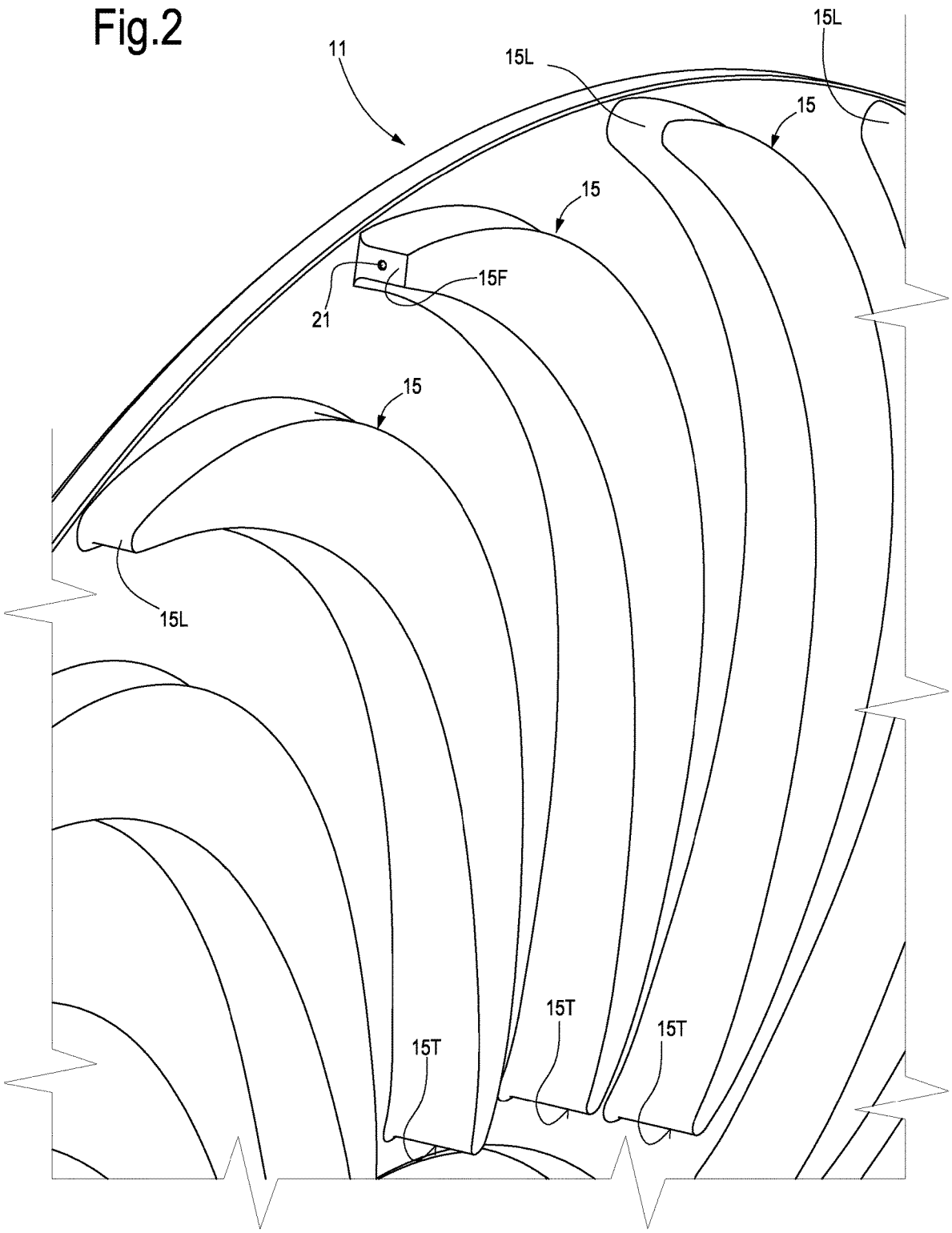
FIG. 2 illustrates a schematic axonometric view of a portion of a bladed return channel of the centrifugal compressor, including a total pressure measurement arrangement as disclosed herein.
Figure 5:
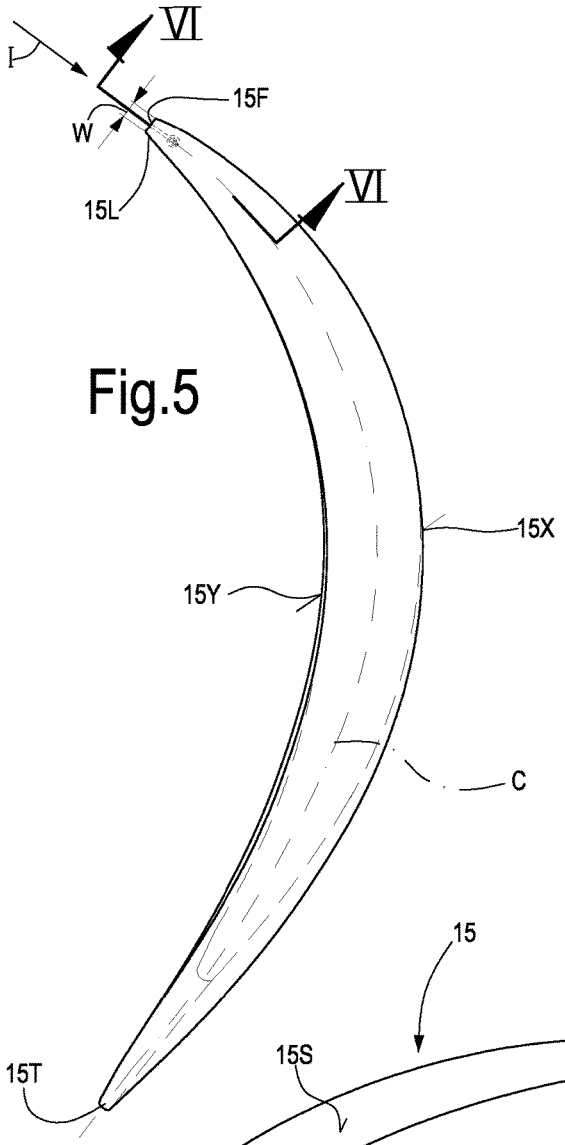
FIG. 5 illustrates a side view according to line V-V of FIG. 3.
Figure 3:
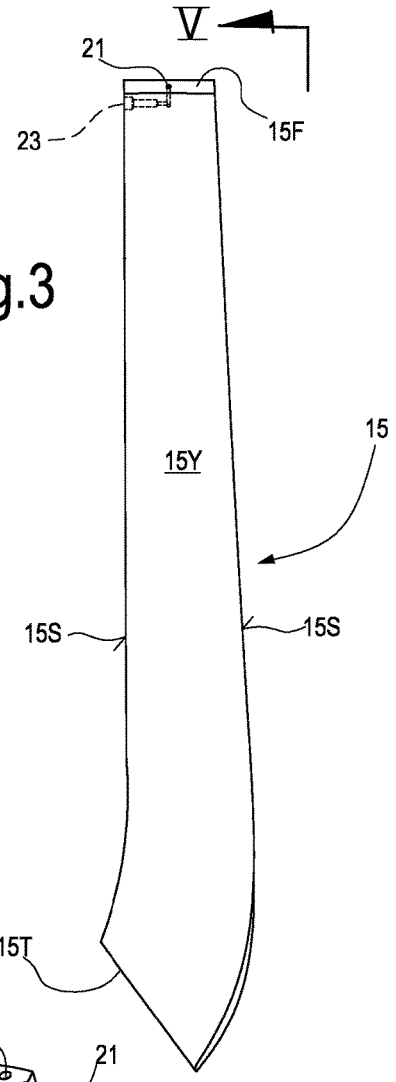
FIG. 3 illustrates a side view of one of the return channel blades of FIGS. 1 and 2, wherein a total pressure measurement arrangement is embedded.
Figure 4:
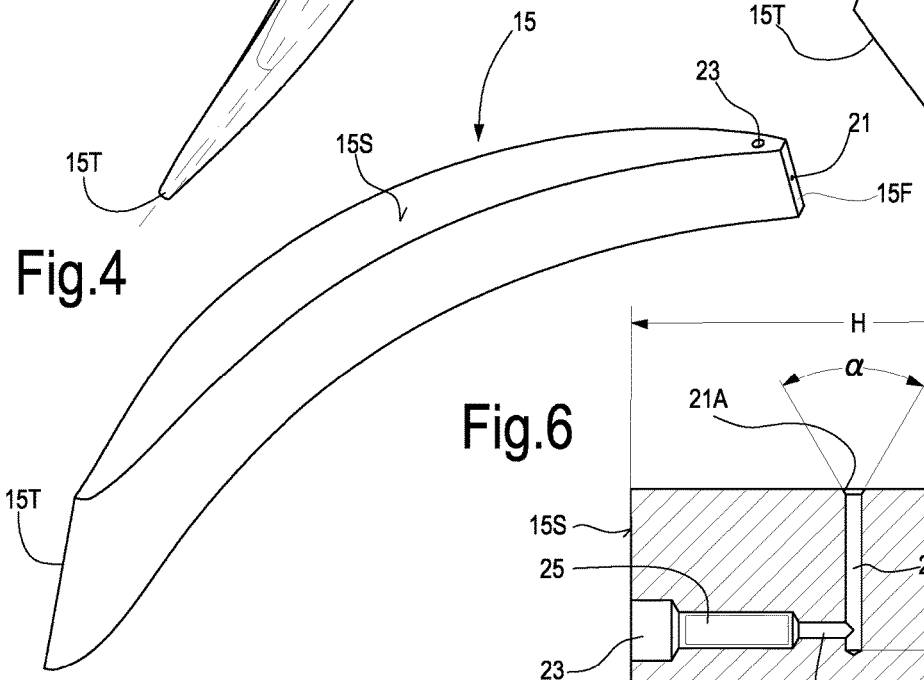
FIG. 4 illustrates a three-dimensional view of the blade of FIG. 3.
Figure 6:
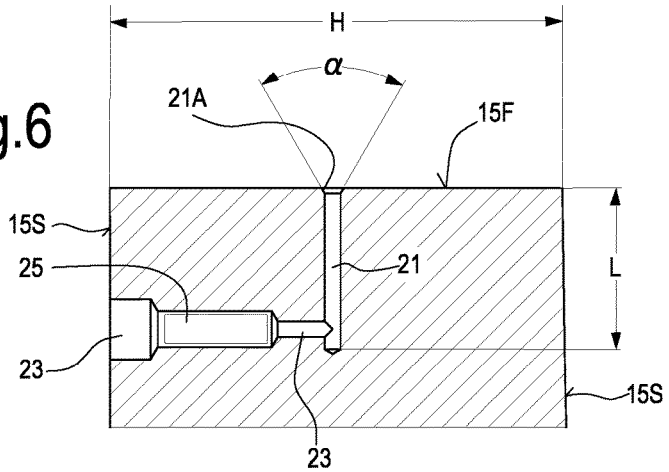
FIG. 6 illustrates a cross-sectional view according to VI-VI of FIG. 5.

In FIG. 2 a plurality of stationary return channel blades 15 are shown in an axonometric view, while FIGS. 3 to 6 show an individual return channel blade 15 provided with total pressure measurement means, in isolation and parts thereof. According to some embodiments, the leading edge 15L of the return channel blade 15 is flattened as shown at 15F (FIGS. 3 and 6). In embodiments, the flattened surface 15F can be planar. In some embodiments the planar flattened surface 15F can be substantially orthogonal to the design direction of incidence I (FIG. 5) of the airfoil profile defined by the two opposed airfoil surfaces 15X and 15Y (FIG. 5) of the return channel blade 15. The design direction of incidence I is usually tangent to the camber line C of the return channel blade 15.

In other exemplary embodiments the flattened surface 15F can be curved, e.g. it can be a ruled surface with a generatrix parallel to the leading edge. The flattened surface 15F can in these cases be concave.

In some embodiments the flattened surface 15F can have a height H (FIGS. 3 and 6) measured parallel to the leading edge 15L and a width W (FIG. 5) measured in a direction orthogonal to the leading edge and substantially orthogonal to the direction of incidence I. As shown in the attached drawing, the height H of the flattened surface 15F can be the same as the height of the return channel blade 15, i.e. the entire leading edge 15L thereof can be flattened. In other embodiments, however, the height H of the flattened area can be smaller than the height of the return channel blade 15, i.e. the extension of the flattened surface 15F can be smaller than the extension of the leading edge 15L.

A hole 21 (see in particular FIG. 6) is provided in the body of the return channel blade 15. The hole 21 can be oriented according to the design direction of incidence I. The hole 21 forms a total pressure measuring probe. During operation of the centrifugal compressor, the pressure inside the hole 21 will correspond to the total pressure of the working fluid at the leading edge 15L of the return channel blade 15.

If the flattened surface 15F formed at the leading edge 15 is planar, the hole 21 can be orthogonal to the flattened surface 15F. The hole 21 has a hole inlet 21A located at the flattened surface 15F. In some embodiments the hole inlet 21A can be flared, i.e. it can have a frusto-conical shape. The hole 21 is thus a countersunk hole surfacing on the flattened surface 15F. The angle α of the flared surface of the hole inlet 21A of countersunk hole 21 can be between about 15° and about 90°. According to some embodiments, the angle α can be between about 20° and about 80°, for example between about 30° and about 70°, more particularly between about 30° and about 60°.

The hole 21 can extend from the flattened surface 15F into the body of the return channel blade 15 by a length L (FIG. 6) and intersect a lateral duct 23 forming a passage for measuring the total pressure in the hole 21. The lateral duct 23 extends transversely from hole 21 to a side surface 15S of the return channel blade 15. The side surface 15S of the return channel blade 15 is in contact with the diaphragm 7 of the compressor 1. In some embodiments the lateral duct 23 is in fluid communication with an external pressure measuring device, such as a pressure sensor, which can be arranged externally of the compressor casing 5. In FIG. 1 reference number 100 schematically illustrates an external pressure sensor, fluidly connected, e.g. through a pressure duct 101, to the total pressure probe formed by the hole 21.

In other embodiments, a pressure measuring device, such as a pressure sensor 25, can be housed in the side duct 23, as schematically shown in FIG. 6. A wired or wireless data transmission can be provided to transfer pressure data outside the compressor 1.

In yet further embodiments, a pressure sensor can be located in a position inside the compressor casing but outside of the return channel blade 15.

Irrespective of where it is located, the pressure sensor will measure the gas pressure in the hole 21. If the sensor is arranged at 25 inside the lateral duct 23, a wired or wireless connection with an external pressure indication device can be provided.

The pressure in the hole 21 measured by the pressure sensor 25 is the total pressure of the fluid flowing through the centrifugal compressor 1 at the leading edge 15L of the return channel blade 15. The flattened surface 15F and the countersunk hole inlet 21A ensure a reliable total pressure measurement also when the direction of the fluid flow deviates from the design direction of incidence I, e.g. when the compressor operates under non-design conditions. A suitable selection of the diameter D of the hole 1, the angle α, the height H of the flattened surface 15F and the width W of the flattened surface 15F result in reliable measurements of the total pressure within a range of +/−13° or more with respect to the design direction of incidence I of the actual direction of incidence. According to some embodiments, the parameters H, D, W can be selected such that $$0.20 \le \frac{D}{W} \le 0.25$$

and/or $$0.04 \le \frac{D}{H} \le 0.14$$

with values of the countersunk angle α within the ranges set forth herein above.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What we claim is:

1. A turbomachine airfoil component comprising:

an airfoil profile defined by two airfoil surfaces opposed to each other relative to a camber line, the airfoil component extending longitudinally along the camber line and having a first end at one end of the camber line and a second end at the opposite end of the camber line;

a leading edge at one of the first and second ends of the airfoil component and a trailing edge at the other of the first and second ends of the airfoil component; and a hole extending from a hole inlet formed on the leading edge between the two opposed airfoil surfaces towards the interior of the airfoil component and forming a total pressure probe, said hole being fluidly connected to a pressure measuring device.

2. The airfoil component of claim 1, wherein the hole is arranged between the two opposed airfoil surfaces.

3. The airfoil component of claim 1, wherein the leading edge comprises a flattened surface, where the hole inlet is located.

4. The airfoil component of claim 3, wherein the hole has a flared surface at the hole inlet, having an opening angle of between about 15° and about 90°, and wherein the ratio between a diameter of said hole and a width of the flattened surface is comprised between 0.20 and 0.25; or wherein the ratio between the diameter of said hole and a height of the flattened surface is comprised between 0.04 and 0.14.

5. The airfoil component of claim 3, wherein the flattened surface is approximately orthogonal to a design direction of incidence of a fluid flow at the leading edge.

6. The airfoil component of claim 3, wherein the flattened surface has a longitudinal dimension parallel to the leading edge and a transverse dimension orthogonal to the leading edge; and wherein the ratio between a diameter of the hole and the transverse dimension is comprised between 0.20 and 0.25 or wherein the ratio between the diameter of the hole and the longitudinal dimension is comprised between 0.04 and 0.14.

7. The airfoil component of claim 1, wherein the hole inlet has a flared inlet surface with a diameter decreasing towards the interior of the hole.

8. The airfoil component of claim 7, wherein the flared inlet surface has an angle of aperture between about 15° and about 90°.

9. The airfoil component of claim 1, wherein said airfoil component is a turbomachine stationary blade.

10. The airfoil component of claim 1, wherein said component is one of a return-channel blade of a centrifugal compressor, a diffuser blade of a centrifugal compressor, an inlet guide vane, a strut.

11. The airfoil component of claim 1, wherein the pressure measuring device is a pressure transducer, said pressure transducer being housed in a seat formed in the airfoil component.

12. The airfoil component of claim 1, further comprising a pressure duct, fluidly connecting the total pressure probe to the exterior of the airfoil component.

13. A turbomachine comprising at least one stationary airfoil component according to claim 1.

14. A centrifugal compressor comprising:

a casing;

at least a first impeller, configured to be mounted rotation in the casing; and a diffuser stationarily arranged in the casing, wherein the diffuser is provided with stationary blades therein and at least one of said stationary blades is an airfoil component comprising:

an airfoil profile defined by two opposed airfoil surfaces opposed to each other relative to a camber line, the airfoil component extending longitudinally along the camber line and having a first end at one end of the camber line and a second end at the opposite end of the camber line;

a leading edge at one of the first and second ends of the airfoil component and a trailing edge at the other of the first and second ends of the airfoil component; and a hole extending from a hole inlet formed on the leading edge between the two opposed airfoil surfaces towards the interior of the airfoil component and forming a total pressure probe, said hole being fluidly connected to a pressure measuring device.

15. The centrifugal compressor of claim 14, further comprising a return channel stationarily arranged in the casing, wherein the diffuser and the return channel are further arranged in a flow path and at least one of the diffuser and the return channel is provided with stationary blades therein.

16. The centrifugal compressor of claim 14, further comprising a data transfer channel configured to transmit pressure measurement data from the interior of the compressor to the exterior of the compressor.

17. The centrifugal compressor of claim 14, further comprising a pressure transfer duct fluidly connecting the pressure probe formed in the stationary blade to a pressure transducer arranged outside said casing.

18. A method of measuring a total pressure of a working fluid in a flow path inside a turbomachine comprising at least one stationary airfoil component according to claim 1, the method comprising the following steps:

causing the working fluid to flow in the hole in the leading edge transforming kinetic energy thereof into pressure energy in the hole; and measuring the fluid pressure in the hole, said pressure corresponding to the total pressure of the working fluid at the leading edge of the airfoil component.

19. The airfoil component of claim 1, wherein the hole extends at least partially along a portion of the camber line.

* * * * *